US007114433B2

(12) United States Patent
Shenoy et al.

(10) Patent No.: US 7,114,433 B2
(45) Date of Patent: Oct. 3, 2006

(54) VALVE STACK HAVING A PATTERN SWITCHING VALVE

(75) Inventors: Anil Kumar R. Shenoy, Raleigh, NC (US); John R. Connolly, Clayton, NC (US); Ayoub E. Maher, Raleigh, NC (US)

(73) Assignee: Caterpillar, Inc., Peoria, IL (US)

( * ) Notice: Subject to any disclaimer, the term of this patent is extended or adjusted under 35 U.S.C. 154(b) by 33 days.

(21) Appl. No.: 11/045,304

(22) Filed: Jan. 31, 2005

(65) Prior Publication Data

US 2006/0169131 A1 Aug. 3, 2006

(51) Int. Cl.
*F15B 13/08* (2006.01)

(52) U.S. Cl. ..... 91/522; 91/529

(58) Field of Classification Search ..... 91/521, 91/522, 526, 529; 137/636.1, 884
See application file for complete search history.

(56) References Cited

U.S. PATENT DOCUMENTS 4,986,165 A * 1/1991 Miyaoka ..... 91/522
5,235,811 A * 8/1993 Arii et al. ..... 91/529
6,564,896 B1 5/2003 Proksch et al.
6,601,670 B1 * 8/2003 Kaneda et al. ..... 180/333
6,643,577 B1 11/2003 Padgett et al.
6,684,905 B1 * 2/2004 Yamaguchi ..... 91/529
2005/0097787 A1 5/2005 Meyers et al.

FOREIGN PATENT DOCUMENTS

JP 2003083303 3/2003
JP 2004044301 2/2004

OTHER PUBLICATIONS

Image, downloaded Jan. 27, 2005, 1 pg., John Deere Parts Catalog, http://jdpc.deere.com/jdpc/servlet/com.deere,u90490.partscatalog.view.servlets.HomepageServlet_Alt, Model 310SG, 3362—Backhoe 33, 32—Pattern Selector Valve.

* cited by examiner

*Primary Examiner*—Edward K. Look
*Assistant Examiner*—Michael Leslie
(74) *Attorney, Agent, or Firm*—Finnegan, Henderson, Farabow Garrett & Dunner LLP

(57) ABSTRACT

A valve stack for a work machine is disclosed. The valve stack has first and second valve bodies, each with first and second mounting surfaces and first and second valve members. The valve stack further has a third valve body with a mounting surface configured to engage the second mounting surfaces of the first and second valve bodies, and at least one valve member disposed within the third valve body. The at least one valve member is movable between a first position at which movement of a first operator control device corresponds to movement of the first valve member and movement of a second operator control device corresponds to movement of the second valve member, and a second position at which movement of the first operator control device corresponds to movement of the second valve member and movement of the second operator control device corresponds to movement of the first valve member.

25 Claims, 4 Drawing Sheets

VALVE STACK HAVING A PATTERN SWITCHING VALVE

TECHNICAL FIELD

The present disclosure relates generally to a valve stack and, more particularly, to a valve stack having a pattern switching valve.

BACKGROUND

Work machines such as backhoes, excavators, and other work machines have a variety of work implements that are hydraulically operated via one or more operator control devices. The operator control devices may have a particular movement pattern that corresponds to movement of associated work implements. These movement patterns for similar work implements may be different between work machines. For example, a forward tilting movement of a right hand joystick in an excavator arrangement may result in a downward movement of an associated boom, while a forward tilting movement of a left hand joystick in a backhoe arrangement may result in a similar downward movement of the boom. Likewise, a forward tilting movement of the left hand joystick in the excavator arrangement may result in a downward movement of an associated stick, while a forward tilting movement of the right hand joystick in the backhoe arrangement may result in a similar downward movement of the stick. Because of the movement pattern differences between work machines, an operator having experience in an excavator, for example, may find it difficult to efficiently operate a backhoe and, likewise, a backhoe-experienced operator may find it difficult to efficiently operate an excavator.

One method of reducing confusion and efficiency loss associated with the different movement patterns between the operator control devices of different work machines is to implement a switching valve that switches the movement patterns between operator control devices according to operator preference. One such device is described in U.S. Pat. No. 4,986,165 (the '165 patent) issued to Miyaoka on Jan. 22, 1991. The '165 patent describes a hydraulic shovel operating apparatus for operating a plurality of control valves, which control the operation of work devices. The operating apparatus includes a pattern switching valve having a rotary spool inserted into a casing that is remotely located on the hydraulic shovel and connected between pilot and control valves of the hydraulic shovel via hydraulic pipes. The rotary spool may be manually rotated through a predetermined angle to establish differing valve connection patterns of the pilot and control valves.

Although the operating apparatus of the '165 patent may increase operator ease and work efficiency by providing multiple valve connection patterns, the operating apparatus may be expensive, space consuming, and inconvenient for the operator. In particular, because the operating apparatus is remotely located, unique additional mounting hardware and fluid routing components are required that increase the cost of the work machine. Further, because the operating apparatus is remotely located, space on the work machine that might be used for other purposes is consumed, thereby limiting design flexibility of other work machine systems. In addition, because the operating apparatus must be manually rotated to make the valve connections, switching between the various valve connection patterns may be time consuming and inconvenient for the operator.

The disclosed valve stack is directed to overcoming one or more of the problems set forth above.

SUMMARY OF THE INVENTION

In one aspect, the present disclosure is directed to a valve stack for a work machine having a first hydraulic actuator, a second hydraulic actuator, a first operator control device, and a second operator control device. The valve stack includes a first valve body having a first mounting surface and a second mounting surface, and a first valve member disposed within the first valve body and movable to control operation of the first hydraulic actuator. The valve stack also includes a second valve body having a first mounting surface configured to engage the first mounting surface of the first valve body, a second mounting surface, and a second valve member disposed within the second valve body and movable to control operation of the second hydraulic actuator. The valve stack further includes a third valve body having a mounting surface configured to engage the second mounting surfaces of the first and second valve bodies, and at least one valve member disposed within the third valve body. The at least one valve member is in fluid communication with the first and second operator control devices and the first and second valve members. The at least one valve member is movable between a first position at which movement of the first operator control device corresponds to movement of the first valve member and movement of the second operator control device corresponds to movement of the second valve member, and a second position at which movement of the first operator control device corresponds to movement of the second valve member and movement of the second operator control device corresponds to movement of the first valve member.

In another aspect, the present disclosure is directed to a method of assembling a valve stack for a work machine having a first hydraulic actuator, a second hydraulic actuator, a first operator control device, and a second operator control device. The method includes mating a first mounting surface of a first valve body against a first mounting surface of a second valve body. The first valve body houses a first valve member associated with the first hydraulic actuator and the second valve body houses a second valve member associated with the second hydraulic actuator. The method further includes mating a first mounting surface of a third valve body with a second mounting surface of the first valve body and a second mounting surface of the second valve body. The third valve body houses at least one valve member in fluid communication with the first and second operator control devices and the first and second valve members.

DETAILED DESCRIPTION

Figure 1:
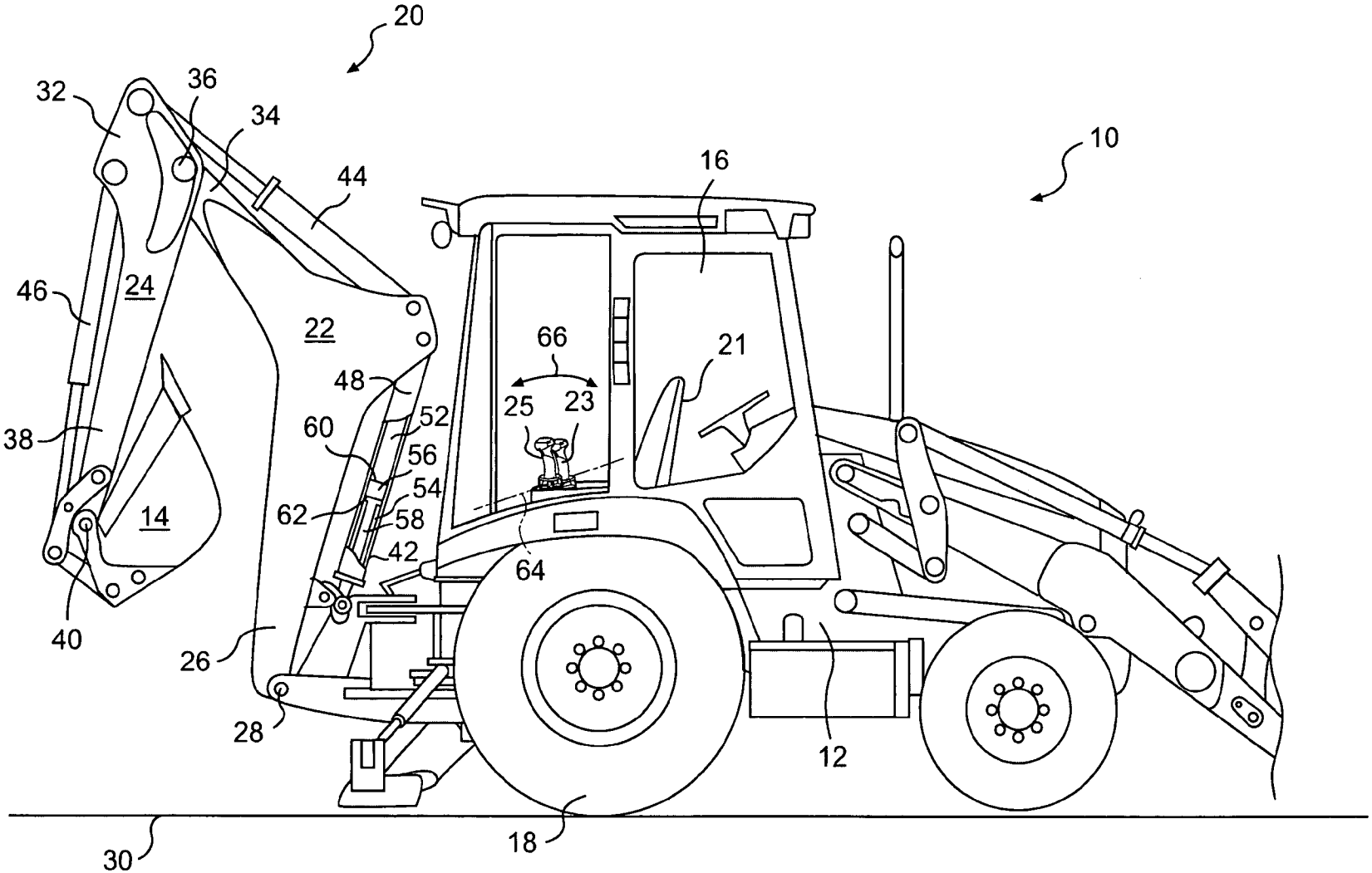
FIG. 1 is a diagrammatic illustration of an exemplary disclosed work machine.

FIG. 1 illustrates an exemplary work machine 10. Work machine 10 may be a fixed or mobile machine that performs some type of operation associated with an industry such as mining, construction, farming, or any other industry known in the art. For example, work machine 10 may be a backhoe, an excavator, or any other work machine known in the art. Work machine 10 may include a machine body 12, at least one work implement 14 movably connected to machine body 12, and an operator station 16 fixed to machine body 12 for operator control of work implement 14.

Machine body 12 may include any structural unit that supports movement of work machine 10 and/or work implement 14. Machine body 12 may include, for example, a stationary base frame (not shown) connecting a power source (not shown) to a traction device 18.

Work implement 14 may include any device used in the performance of a task. For example, work implement 14 may include a shovel, a hammer, an auger, a ripper, or any other task-performing device known in the art. Work implement 14 may be configured to pivot, rotate, slide, swing, or move relative to machine body 12 in any other manner known in the art.

Work implement 14 may be movably connected to machine body 12 by, for example, a linkage system 20. Specifically, work implement 14 may be connected to machine body 12 by way of a boom 22 and a stick 24. Boom 22 may include a first end 26 that is pivotally connected to machine body 12 for upward and downward pivotal movement about a pivot axis 28, relative to a horizontal working surface 30. Stick 24 may have a first end 32 that is pivotally connected to a second end 34 of boom 22 for pivotal movement about a pivot axis 36 to move a second end 38 inward and outward relative to machine body 12. Work implement 14 may be pivotally connected to second end 38 and configured to curl about a pivot axis 40 during a digging operation and to uncurl during a dumping operation.

Linkage system 20 may be movable by a plurality of hydraulic cylinders. In particular, a hydraulic cylinder 42 may be expandable and retractable to move stick 24 and work implement 14 downward and upward relative to working surface 30. A hydraulic cylinder 44 may be expandable and retractable to move work implement inward and outward relative to machine body 12. A hydraulic cylinder 46 may be expandable and retractable to curl and uncurl work implement 14.

As illustrated with respect to hydraulic cylinder 42, each of hydraulic cylinders 42–46 may include a tube 48 and a piston assembly disposed within tube 48. The piston assembly may divide tube 48 into a first chamber 52 and a second chamber 54. First and second chambers 52, 54 may be selectively supplied with a pressurized fluid and drained of the pressurized fluid to cause the piston assembly to displace within tube 48, thereby changing the effective length of hydraulic cylinders 42–46. The expansion and retraction of hydraulic cylinders 42–46 may assist in moving work implement 14.

The piston assembly may include a piston 56 axially aligned with and disposed within tube 48, and a piston rod 58. Piston 56 may include two opposing hydraulic surfaces, one associated with each of first and second chambers 52, 54. An imbalance of force created by fluid pressure acting on the two surfaces may cause the piston assembly to axially move within tube 48. For example, a force acting on a first hydraulic surface 60 being greater than a force acting on a second opposing hydraulic surface 62 may cause the piston assembly to displace and increase the effective length of hydraulic cylinders 42–46. Similarly, when a force acting on second hydraulic surface 62 is greater than a force acting on first hydraulic surface 60, the piston assembly may retract within tube 48 and decrease the effective length of hydraulic cylinders 42–46. A sealing member (not shown), such as an o-ring, may be connected to piston 56 to restrict a flow of fluid between an internal wall of tube 48 and an outer cylindrical surface of piston 56.

Operator station 16 may be used to control the movement of hydraulic cylinders 42–46. Operator station 16 may include a seat 21 and one or more operator control devices. In particular, operator station 16 may include a first operator control device 23 disposed to the right of seat 21, and a second operator control device 25 disposed to the left of seat 21. Each of first and second operator control devices 23, 25 may be connected to seat 21, to a floor (not shown) of operator station 16, to a wall (not shown) of operator station 16, or in any other manner known in the art.

First operator control device 23 may be movable to control expansion and retraction of hydraulic cylinder 42. Specifically, first operator control device may be tiltable about a pivot axis 64 in the direction of arrow 66 to cause hydraulic cylinder 42 to expand and retract. For example, a fore tilting motion of first operator control device 23, away from seat 21, may cause an expansion of hydraulic cylinder 42. Likewise, an aft tilting motion of first operator control device 23, toward seat 21, may cause a retraction of hydraulic cylinder 42.

Second operator control device 25 may be movable to control expansion and retraction of hydraulic cylinder 44. Specifically, second operator control device may be tiltable about pivot axis 64 in the direction of arrow 66 to cause hydraulic cylinder 44 to expand and retract. For example, a fore tilting motion of second operator control device 25 away from seat 21 may cause an expansion of hydraulic cylinder 44. Likewise, an aft tilting motion of second operator control device 25 toward seat 21 may cause a retraction of hydraulic cylinder 44.

Figure 2:
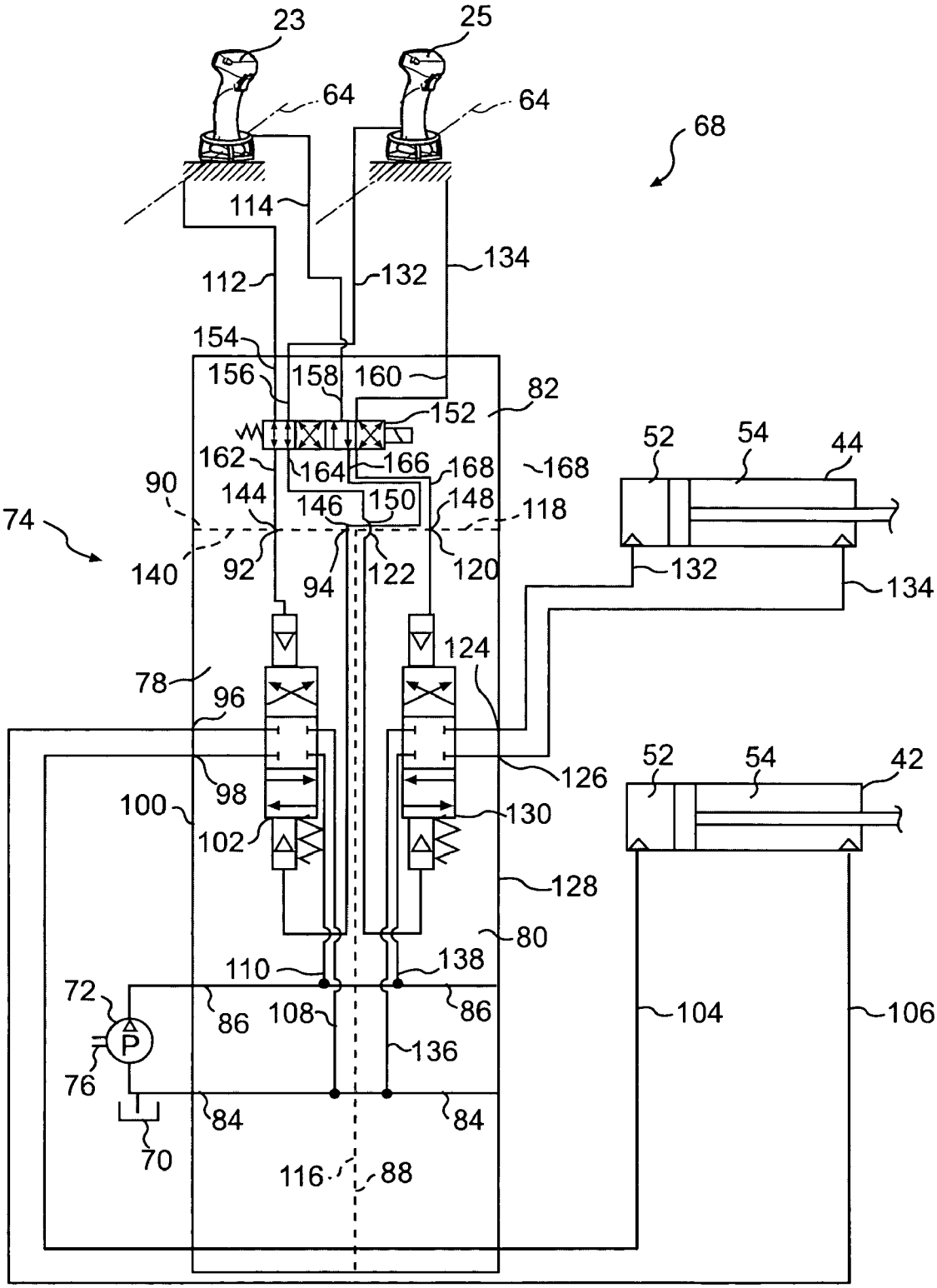
FIG. 2 is a diagrammatic and schematic illustration of an exemplary disclosed valve stack for the work machine of FIG. 1

As illustrated in FIG. 2, work machine 10 may include a hydraulic system 68 having multiple components fluidly connecting first and second operator control devices 23, 25 to hydraulic cylinders 42 and 44. Hydraulic system 68 may include a tank 70, a source of pressurized fluid 72, and a valve stack 74. It is contemplated that hydraulic system 68 may include additional and/or different components such as, for example, accumulators, restrictive orifices, check valves, pressure relief valves, makeup valves, pressure-balancing passageways, and other components known in the art.

Tank 70 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 70. It is also contemplated that hydraulic system 68 may be connected to multiple separate fluid tanks.

Source 72 may be configured to produce a flow of pressurized fluid and may include a pump such as, for example, a variable displacement pump, a fixed displacement pump, a variable delivery pump, or any other source of pressurized fluid known in the art. Source 72 may be drivably connected to the power source of work machine 10 by, for example, a countershaft 76, a belt (not shown), an electrical circuit (not shown), or in any other suitable manner. Alternately, source 72 may be indirectly connected to the power source via a torque converter (not shown), a gear box (not shown), or in any other appropriate manner. It is contemplated that multiple sources of pressurized fluid may be interconnected to supply pressurized fluid to hydraulic system 68.

Valve stack 74 may include multiple components configured to control the metering of pressurized fluid between hydraulic cylinders 42 and 44, source 72, and tank 70, in response to movement of first and second operator control devices 23, 25. Specifically, valve stack 74 may include a first control valve body 78 associated with hydraulic cylinder 42, a second control valve body 80 associated with hydraulic cylinder 44, and a switching valve body 82. Each of first and second control valve bodies 78 and 80 may include a common fluid passageway 84 in communication with tank 70 and a common fluid passageway 86 in communication with source 72. It is contemplated that additional control valve bodies may be included within valve stack 74 such as, for example, a control valve body associated with hydraulic cylinder 46.

First control valve body 78 may include multiple mounting surfaces and fluid ports. In one example, first control valve body 78 includes a first mounting surface 88 and a second mounting surface 90. Second mounting surface 90 may include at least two fluid ports 92 and 94. First control valve body 78 may also include two fluid ports 96, 98 disposed within an external surface 100.

First control valve body 78 may include at least one pilot operated valve element 102 configured to meter the flow of pressurized fluid to and from hydraulic cylinder 42. Specifically, pilot operated valve element 102 may be in fluid communication with first chamber 52 of hydraulic cylinder 42 via a fluid passageway 104, and with second chamber 54 of hydraulic cylinder 42 via a fluid passageway 106. Pilot operated valve element 102 may also be in fluid communication with common fluid passageway 84 via a fluid passageway 108, and with common fluid passageway 86 via a fluid passageway 110.

Pilot operated valve element 102 may be actuated in response to movement of first operator control device 23 against a spring bias to move between a first position, a second position, and a third position. Specifically, as first operator control device 23 is moved in either the fore or aft directions, plungers (not shown) associated with first operator control device 23 may pressurize fluid and direct the pressurized fluid to opposing ends of pilot operator valve element 102 via either a fluid passageway 112 or a fluid passageway 114. When pilot operated valve element 102 is moved to the first position, pressurized fluid from source 72 may be allowed to flow into one of first and second chambers 52, 54 of hydraulic cylinder 42, while fluid is allowed to drain from the other of first and second chambers 52, 54 to tank 70. When moved to the second position, the flow directions are reversed. In the third position, fluid flow is blocked from both of first and second chambers 52, 54. The location of pilot operated valve element 102 between the first, second, and third positions may determine a flow rate of the pressurized fluid directed into and out of first and second chambers 52, 54.

Second control valve body 80 may include multiple mounting surfaces and fluid ports. In one example, second control valve body 80 includes a first mounting surface 116 configured to mate against first mounting surface 88 of first control valve body 78, and a second mounting surface 118. Second mounting surface 118 may include at least two fluid ports 120, 122. Second control valve body 80 may also include two fluid ports 124, 126 disposed within an external surface 128.

Second control valve body 80 may include at least one pilot operated valve element 130 configured to meter the flow of fluid to and from hydraulic cylinder 44. Specifically, pilot operated valve element 130 may be in fluid communication with first chamber 52 of hydraulic cylinder 44 via a fluid passageway 132, and with second chamber 54 of hydraulic cylinder 44 via a fluid passageway 134. Pilot operated valve element 130 may also be in fluid communication with common fluid passageway 84 via a fluid passageway 136, and with common fluid passageway 86 via a fluid passageway 138.

Pilot operated valve element 130 may be actuated in response to movement of second operator control device 25 against a spring bias to move between a first position, a second position, and a third position. Specifically, as second operator control device 25 is moved in either the fore or aft directions, plungers (not shown) associated with second operator control device 25 may pressurize fluid and direct the pressurized fluid to opposing ends of pilot operator valve element 130 via either a fluid passageway 132 or a fluid passageway 134. When pilot operated valve element 130 is moved to the first position, pressurized fluid from source 72 is allowed to flow into one of first and second chambers 52, 54 of hydraulic cylinder 44, while fluid may be allowed to drain from the other of first and second chambers 52, 54 to tank 70. When moved to the second position, the flow directions are reversed. In the third position, fluid flow is blocked from both of first and second chambers 52, 54. The location of pilot operated valve element 130 between the first, second, and third positions may determine a flow rate of the pressurized fluid directed into and out of first and second chambers 52, 54.

Switching valve body 82 may include a mounting surface and multiple fluid ports. In one example, switching valve body 82 includes a mounting surface 140 configured to mate against second mounting surfaces 90 and 118 of first and second control valve bodies 78, 80. Mounting surface 140 may include four fluid ports 144, 146, 148, 150 configured to communicate with fluid ports 92, 94, 120, and 122, respectively.

Switching valve body 82 may include at least one proportional valve element 152 configured to switch the flow pattern of fluid between first and second operator control devices 23, 25 and first and second control valve bodies 78, 80. Specifically, proportional valve element 152 may be in fluid communication with fluid passageways 112, 114, 132, and 134 via fluid passageways 154, 156, 158, and 160, respectively. Proportional valve element 152 may also be in fluid communication with fluid ports 144–150 via fluid passageways 162, 164, 166, and 168, respectively.

Proportional valve element 152 may be solenoid actuated against a spring bias to move between first and second positions. In one example, when proportional valve element 152 is in the first position, pressurized fluid from first operator control device 23 affects movement of pilot operated valve element 102, while pressurized fluid from operator control device 25 affects movement of pilot operated valve element 130. When proportional valve element 152 is in the second position, the control pattern is switched and pressurized fluid from operator control device 25 affects movement of pilot operated valve element 102, while pressurized fluid from operator control device 23 affects movement of pilot operated valve element 130.

Valve stack 74 may include sealing devices to restrict leakage from between the valve bodies of valve stack 74. In particular, a sealing device such as, for example, an o-ring (not shown) may be disposed about each fluid port between switching valve body 82 and first and second control valve bodies 78, 80, and about common passageways 84 and 86 between first and second control valve bodies 78, 80. It is contemplated that different sealing devices such as, for example, gaskets, liquid sealing, or other suitable sealing devices may alternatively be implemented.

Figure 3:
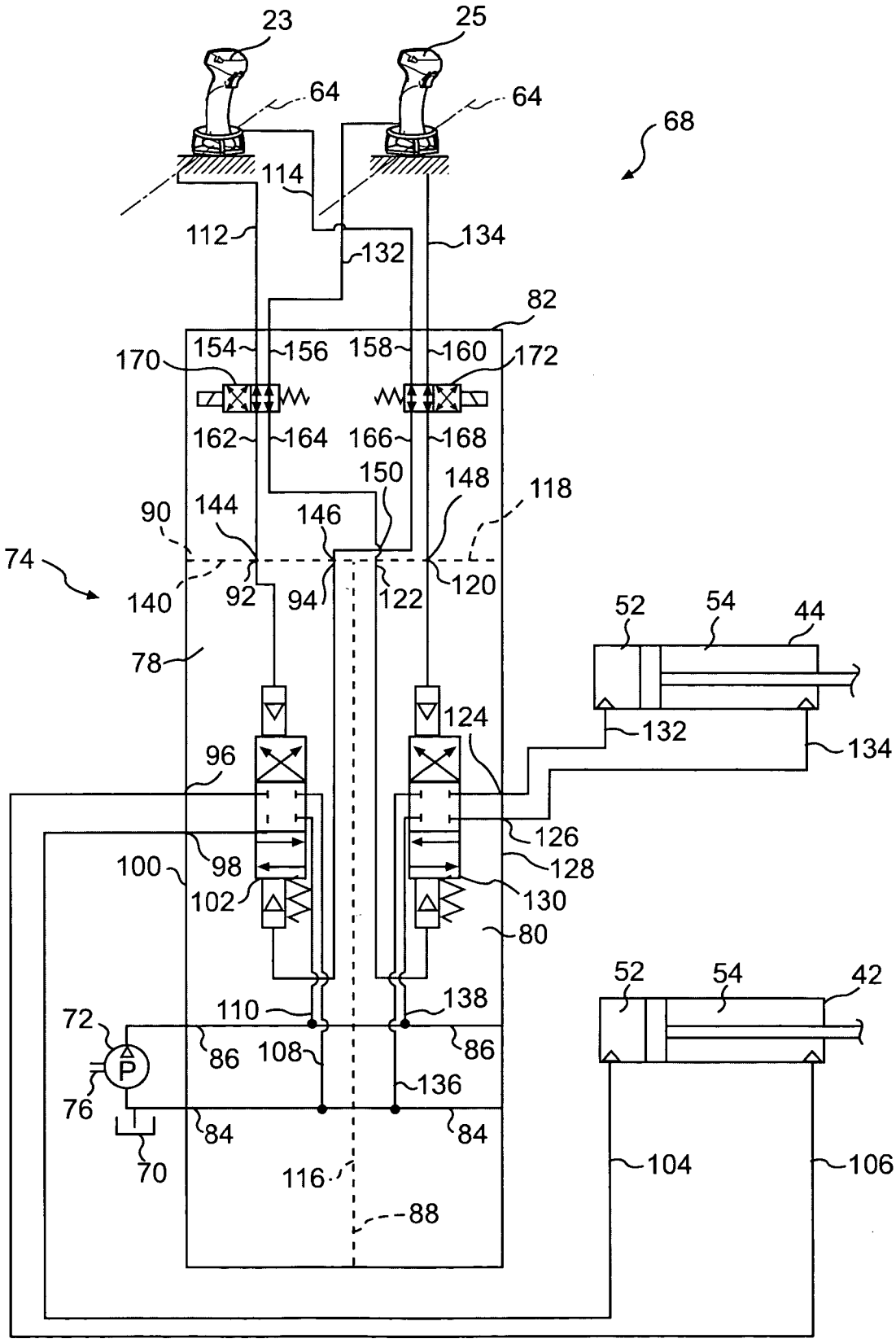
FIG. 3 is a diagrammatic and schematic illustration of another exemplary disclosed valve stack for the work machine of FIG. 1.

FIG. 3 illustrates another embodiment of hydraulic system 68. Similar to the embodiment of FIG. 2, hydraulic system 68 of FIG. 3 includes tank 70, source of pressurized fluid 72, and valve stack 74, having first control, second control, and switching valve bodies 78, 80, and 82. However, in contrast to the single proportional valve element 152 of switching valve body 82 illustrated FIG. 2, switching valve body 82 of FIG. 3 houses two separate proportional valve elements 170, 172 configured to switch the flow pattern of fluid between first and second operator control devices 23, 25 and first and second control valve members 102, 130. Specifically, proportional valve element 170 may be in fluid communication with fluid passageways 112 and 114 via fluid passageways 154 and 156, while proportional valve element 172 may be in fluid communication with fluid passageways 132 and 134 via fluid passageways 158 and 160. Proportional valve element 170 may also be in fluid communication with fluid ports 144 and 146 via fluid passageways 162 and 164, while proportional valve element 172 may be in fluid communication with fluid ports 148 and 150 via fluid passageways 168 and 166.

Proportional valve elements 170 and 172 may be solenoid actuated against a spring bias to move between first and second positions. In one example, when proportional valve elements 170 and 172 are each in the first position, pressurized fluid from first operator control device 23 affects movement of pilot operated valve element 102, while pressurized fluid from second operator control device 25 affects movement of pilot operated valve element 130. When proportional valve elements 170 and 172 are each in the second position, the control pattern is switched and pressurized fluid from second operator control device 25 affects movement of pilot operated valve element 102, while pressurized fluid from first operator control device 23 affects movement of pilot valve element 130.

Figure 4:
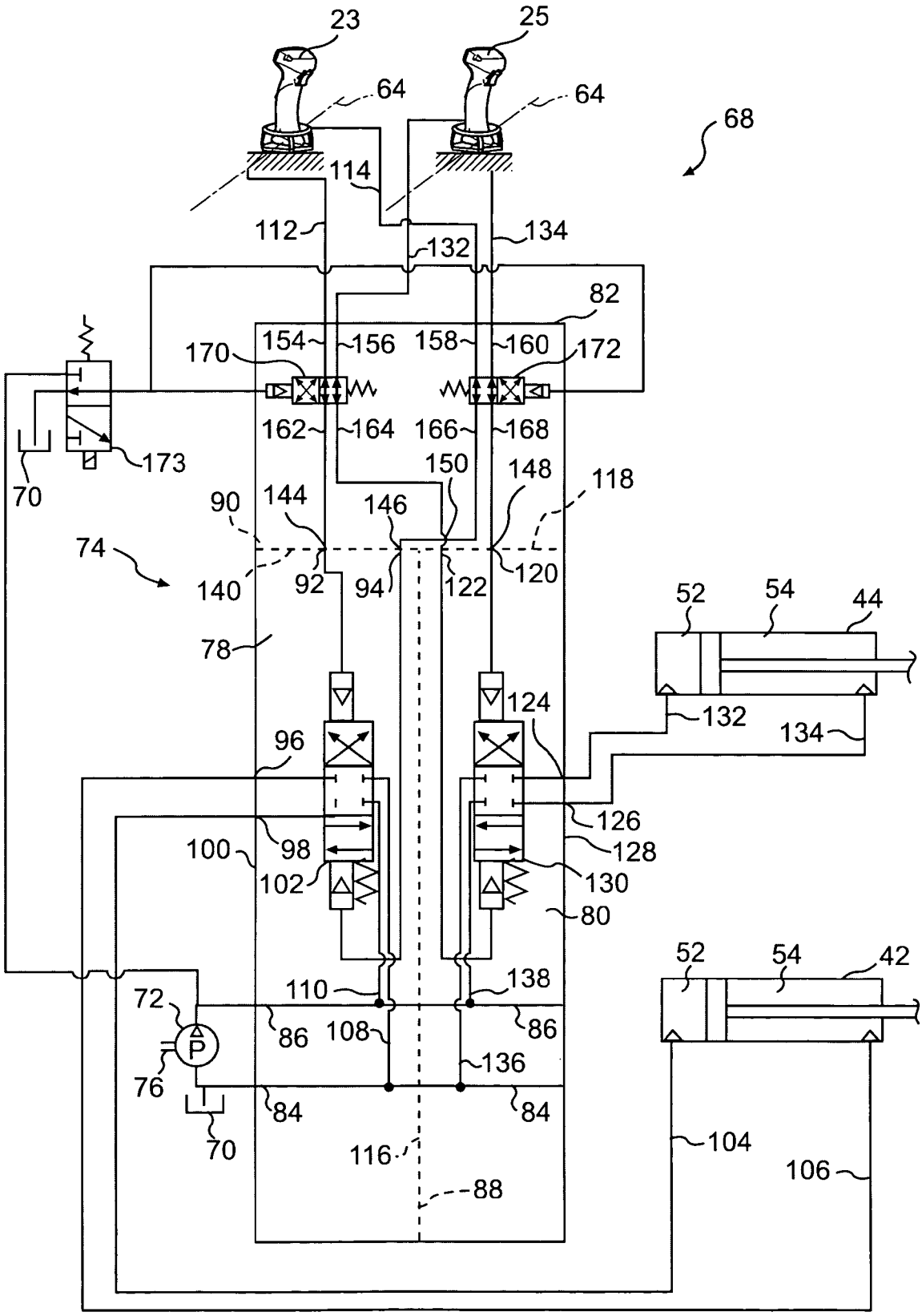
FIG. 4 is a diagrammatic and schematic illustration of another exemplary disclosed valve stack for the work machine of FIG. 1.

FIG. 4 illustrates another embodiment of hydraulic system 68. Similar to the embodiment of FIG. 3, hydraulic system 68 of FIG. 3 includes tank 70, source of pressurized fluid 72, valve stack 74 having first control, second control, and switching valve bodies 78, 80, and 82. However, in contrast to the two separate proportional valve elements 170, 172 of switching valve body 82 illustrated FIG. 3 being solenoid actuated, switching valve body 82 of FIG. 4 houses two separate valve elements 170, 172 that are pilot actuated against a spring bias. Specifically, hydraulic system 68 may include an additional solenoid actuated valve element 173 disposed between source 72 and tank 70, and proportional valve elements 170, 172. It is contemplated that solenoid actuated valve element 173 may or may not be disposed within switching valve body 82.

Solenoid actuated valve element 173 may be actuated against a spring bias to move between first and second positions. In one example, when solenoid actuated valve element 173 is in the first position, pressurized fluid from source 72 is communicated with ends of pilot operated proportional valve elements 170, 172 to affect the movement of pilot operated valve elements 170, 172 in a first direction. When solenoid actuated valve element 173 is in the second position, fluid is drained from the ends of pilot operated valve elements 170, 172 to tanke 70, thereby affecting movement of pilot operated valve elements 170, 172 in a second direction opposite to the first. It is contemplated that and additional source may alternatively be implemented to supply a pilot stream of pressurized fluid to valve elements 170–173, instead of source 72.

INDUSTRIAL APPLICABILITY

The disclosed valve stack finds potential application in any system where it is desirable to switch operational control patterns of different operator control devices. The disclosed valve stack is simple, inexpensive, compact, and conveniently actuated.

The proximity of switching valve body 82 relative to first and second control valve bodies 78 and 80 reduces system complexity and expense, while improving design flexibility of other work machine systems. In particular, because switching valve body 82 mounts directly to first and second control valve bodies 78 and 80, the use of complicated and expensive fluid routing components may be minimized. This reduction in fluid routing components may free up space on machine body 12 that could be used for the design of other work machine systems, which also reduces assembly and maintenance time of work machine 10. In addition, bracketry required to remotely mount switching valve body 82 may be minimized or even eliminated, which further reduces the complexity and cost associated with valve stack 74.

Because pattern switching may be electronically initiated, operator convenience may be improved. Specifically, proportional valve elements 152, 170, and 172 being electronically controlled allows the operator to switch between operational patterns at the flick of a button or switch while remaining within operator station 16, rather than requiring the operator to exit operator station 16 and manually turn a remotely mounted valve stack.

It will be apparent to those skilled in the art that various modifications and variations can be made to the valve stack of the present disclosure. Other embodiments of the valve stack will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A valve stack for a work machine having a first hydraulic actuator, a second hydraulic actuator, a first operator control device, and a second operator control device, the valve stack comprising:

a first valve body having a first mounting surface and a second mounting surface;

a first valve member disposed within the first valve body and movable to control operation of the first hydraulic actuator;

a second valve body having a first mounting surface configured to engage the first mounting surface of the first valve body, and a second mounting surface;

a second valve member disposed within the second valve body and movable to control operation of the second hydraulic actuator;

a third valve body having a mounting surface configured to engage the second mounting surfaces of the first and second valve bodies; and at least one valve member disposed within the third valve body in fluid communication with the first and second operator control devices and the first and second valve members, the at least one valve member being movable between a first position at which movement of the first operator control device corresponds to movement of the first valve member and movement of the second operator control device corresponds to movement of the second valve member, and a second position at which movement of the first operator control device corresponds to movement of the second valve member and movement of the second operator control device corresponds to movement of the first valve member.

2. The valve stack of claim 1, wherein the at least one valve member is electrically operated.

3. The valve stack of claim 1, wherein the first and second valve members are pilot operated.

4. The valve stack of claim 1, wherein the work machine includes a source of pressurized fluid and a reservoir, and the first and second valve bodies each include a first common fluid passageway in communication with the source of fluid and a second common fluid passageway in communication with the reservoir.

5. The valve stack of claim 4, wherein the first and second valve members are in fluid communication with the first and second common fluid passageways.

6. The valve stack of claim 1, wherein the second mounting surfaces of the first and second valve bodies each include two ports and the mounting surface of the third valve body includes four ports that fluidly communicate with the two ports in the second mounting surfaces of the first and second valve bodies.

7. The valve stack of claim 6, further including a plurality of o-rings disposed between the mounting surface of the third valve body and the second mounting surfaces of the first and second valve bodies to restrict leakage between the four ports of the third valve body and the two ports in the second mounting surfaces of the first and second valve bodies.

8. A valve stack for a work machine having a first hydraulic actuator, a second hydraulic actuator, a first operator control device, and a second operator control device, the valve stack comprising:

a first valve body having a first mounting surface and a second mounting surface;

a first valve member disposed within the first valve body and movable to control operation of the first hydraulic actuator;

a second valve body having a first mounting surface configured to engage the first mounting surface of the first valve body, and a second mounting surface;

a second valve member disposed within the second valve body and moveable to control operation of the second hydraulic actuator;

a third valve body having a mounting surface configured to engage the second mounting surfaces of the first and second valve bodies;

a third valve member disposed within the third valve body, in fluid communication with the first and second operator control devices and the first and second valve members; and a fourth valve member disposed within the third valve body, in fluid communication with the first and second operator control devices and the first and second valve members, wherein the third and fourth valve members are movable between first positions at which movement of the first operator control device corresponds to movement of the first valve member and movement of the second operator control device corresponds to movement of the second valve member, and second positions at which movement of the first operator control device corresponds to movement of the second valve member and movement of the second operator control device corresponds to movement of the first valve member.

9. The valve stack of claim 8, wherein the third and fourth valve members are electrically operated.

10. The valve stack of claim 8, wherein the third and fourth valve members are pilot operated.

11. The valve stack of claim 8, wherein the first and second valve members are pilot operated.

12. The valve stack of claim 8, wherein the work machine includes a source of pressurized fluid and a reservoir, and the first and second valve bodies each include a first common fluid passageway in communication with the source of fluid and a second common fluid passageway in communication with the reservoir.

13. The valve stack of claim 12, wherein the first and second valve members are in fluid communication with the first and second common fluid passageways.

14. The valve stack of claim 8, wherein the second mounting surfaces of each of the first and second valve bodies each include two ports and the mounting surface of the third valve body includes four ports that fluidly communicate with the two ports in the second mounting surfaces of the first and second valve bodies.

15. The valve stack of claim 14, further including a plurality of o-rings disposed between the mounting surface of the third valve body and the second mounting surfaces of the first and second valve bodies to restrict leakage between the four ports of the third valve body and the two ports in the second mounting surfaces of the first and second valve bodies.

16. A method of assembling a valve stack for a work machine having a first hydraulic actuator, a second hydraulic actuator, a first operator control device, and a second operator control device, the method comprising:

mating a first mounting surface of a first valve body against a first mounting surface of a second valve body, the first valve body housing a first valve member associated with the first hydraulic actuator and the second valve body housing a second valve member associated with the second hydraulic actuator; and mating a first mounting surface of a third valve body with a second mounting surface of the first valve body and a second mounting surface of the second valve body, the third valve body housing at least one valve member in fluid communication with the first and second operator control devices and the first and second valve members.

17. The method of claim 16, further including positioning a plurality of o-rings between the first mounting surface of the third valve body and the second mounting surfaces of the first and second valve bodies to restrict leakage between the ports in the third valve body and the ports in each of the first and second valve bodies.

18. A method of assembling a valve stack for a work machine having a first hydraulic actuator, a second hydraulic actuator, a first operator control device, and a second operator control device, the method comprising:

mating a first mounting surface of a first valve body against a first mounting surface of a second valve body, the first valve body housing a first valve member associated with the first hydraulic actuator and the second valve body housing a second valve member associated with the second hydraulic actuator; and mating a first mounting surface of a third valve body with a second mounting surface of the first valve body and a second mounting surface of the second valve body, the third valve body housing a third valve member in fluid communication with the first and second operator control devices and the first and second valve members, and a fourth valve member in fluid communication with the first and second operator control devices and the first and second valve members.

19. The method of claim 18, further including positioning a plurality of o-rings between the first mounting surface of the third valve body and the second mounting surfaces of the first and second valve bodies to restrict leakage between the ports in the third valve body and the ports in each of the first and second valve bodies.

20. A work machine, comprising:

a first hydraulic actuator configured to move a boom of the work machine;

a second hydraulic actuator configured to move a stick of the work machine;

a first operator control device;

a second operator control device; and a valve stack including:

a first valve body having a first mounting surface and a second mounting surface;

a first valve member disposed within the first valve body and configured to control movement of the boom;

a second valve body having a first mounting surface configured to engage the first mounting surface of the first valve body, and a second mounting surface;

a second valve member disposed within the second valve body and configured to control movement of the stick;

a third valve body having a mounting surface configured to engage the second mounting surfaces of the first and second valve bodies;

a third valve member disposed within the third valve body, the third valve member being in fluid communication with the first and second operator control devices and the first and second valve members; and a fourth valve member disposed within the third valve body, the fourth valve member being in fluid communication with the first and second operator control devices and first and second valve members, wherein the third and fourth valve members are movable between first positions at which movement of the first operator control device corresponds to movement of the first valve member and movement of the second operator control device corresponds to movement of the second valve member, and second positions at which movement of the first operator control device corresponds to movement of the second valve member and movement of the second operator control device corresponds to movement of the first valve member.

21. The work machine of claim 20, wherein the third and fourth valve members are electrically operated, and the first and second valve members are pilot operated.

22. The work machine of claim 20, wherein each of the first, second, third, and fourth valve members are pilot operated.

23. The work machine of claim 20, wherein the work machine includes a source of pressurized fluid and a reservoir, the first and second valve bodies each include a first common fluid passageway in communication with the source of fluid and a second common fluid passageway in communication with the reservoir, and the first and second valve members are in fluid communication with the first and second common fluid passageways.

24. The work machine of claim 20, wherein the second mounting surfaces of each of the first and second valve bodies each include two ports and the mounting surface of the third valve body includes four ports that fluidly communicate with the two ports in the second mounting surfaces of the first and second valve bodies.

25. The work machine of claim 24, further including a plurality of o-rings disposed between the mounting surface of the third valve body and the second mounting surfaces of the first and second valve bodies to restrict leakage between the four ports of the third valve body and the two ports in the second mounting surfaces of the first and second valve bodies.

* * * * *